US005360281A

United States Patent [19]

Kamen et al.

[11] Patent Number: 5,360,281

[45] Date of Patent: Nov. 1, 1994

[54] COSMETIC PENCIL AND METHOD FOR MAKING THE SAME

[75] Inventors: Melvin E. Kamen, Highlands, N.J.; Philip Bernstein, Yardley, Pa.

[73] Assignee: Revlon Consumer Products Corporation, New York, N.Y.

[21] Appl. No.: 968,915

[22] Filed: Oct. 30, 1992

Related U.S. Application Data

[63] Continuation of Ser. No. 614,793, Nov. 15, 1990, abandoned.

[51] Int. Cl.[5] ..... A45D 40/00; A45D 40/20; B43K 19/14

[52] U.S. Cl. ..... 401/96; 264/46.1

[58] Field of Search ..... 401/96; 264/46.1

[56] References Cited

U.S. PATENT DOCUMENTS

| | | | |
|---|---|---|---|
| 2,790,202 | 4/1957 | Lorenian . | |
| 2,988,784 | 6/1961 | Lorenian . | |
| 3,704,071 | 11/1972 | Muller et al. | 401/96 |
| 3,875,088 | 4/1975 | Arons et al. . | |
| 3,936,519 | 2/1976 | Crystal . | |
| 3,993,408 | 11/1976 | Arons et al. . | |
| 4,176,978 | 12/1979 | Ruzicka et al. . | |
| 4,230,655 | 10/1980 | Kruckel et al. | 401/96 X |
| 4,413,921 | 11/1983 | Fotiu et al. . | |
| 5,021,523 | 6/1991 | Iizuka et al. | 525/537 |

FOREIGN PATENT DOCUMENTS

| | | | |
|---|---|---|---|
| 154937 | 1/1954 | Australia | 401/96 |
| 1461292 | 9/1964 | Germany | 401/96 |
| 4519124 | 2/1966 | Japan | 401/96 |
| 50-8364 | 4/1975 | Japan | 401/96 |
| 5361281 | 10/1976 | Japan | 401/96 |
| 54-41813 | 5/1978 | Japan | 401/96 |
| 54-31316 | 8/1979 | Japan | 401/96 |

*Primary Examiner*—Steven A. Bratlie
*Attorney, Agent, or Firm*—Julie Blackburn

[57] ABSTRACT

A pencil barrel is prepared by extruding, shaping, and cooling, under controlled conditions, a foamable, thermoplastic resin-based composition. The combination of the particular extrudable composition and the means of shaping and cooling the tubular extrudate obtained therefrom are readily useful as barrels, i.e. sheaths, for sharpenable pencils, particularly in the cosmetic industry. The resultant pencil barrels are characterized by their sharpenability, uniform satin-matte smoothness, outstanding printability, and their prolonged resistance to atmospheric conditions. The method for making said pencil barrels is also disclosed.

5 Claims, 3 Drawing Sheets

COSMETIC PENCIL AND METHOD FOR MAKING THE SAME

This is a continuation Ser. No. 07/614,793 filed on Nov. 15, 1990 now abandoned.

FIELD OF THE INVENTION

The present invention relates to cosmetic products. More particularly, it relates to cosmetic pencils having barrels fabricated from an extrudable foamable, thermoplastic-based composition. This invention also relates to methods including extruding said composition under controlled conditions to provide the barrels.

BACKGROUND OF THE INVENTION

Conventional sharpenable pencil barrels have been fabricated from natural substances such as wood, wood flour, treated cellulosic fibers, and synthetic materials such as plastic polymers.

Manufacturing of wooden and wood-product pencils usually involves multi-step techniques. Such procedures have become expensive, due to the increasing cost of raw materials, excessive time consumption, and the number of rejects encountered.

Because of the prohibitive impact of rapidly increasing operational costs, many pencil manufacturers have replaced wood with synthetic materials to make the pencil barrels or sheaths.

In the cosmetic industry when employing synthetics for the fabrication of pencil sheaths or barrels, certain requirements are necessary in order to yield the desired finished products. For instance, the composition of the synthetic barrel material must be compatible with that of the particular cosmetic core to prevent contamination of the cosmetic product by the synthetic or vice versa. Also, the selected material must be sharpenable, of adequate rigidity and resistant to normal atmospheric conditions in order to maintain a desired barrel shape.

As indicated above, polymeric materials, particularly thermopolymers, have been used in place of wood to make the pencil barrels. Because of the nature of such plastics, manufacturers have developed numerous extrusion techniques for manufacturing pencil barrels.

Some extrusion methods for producing pencil barrels are disclosed in U.S. Pat. Nos. 2,790,202; 2,988,784; 3,875,088; 3,936,519; 3,993,408; and 4,176,978. The barrel compositions respectively include thermoplastic binders and plasticizers in combination with other ingredients such as wood flour, a waxy substance, and a lubricant. Other extrudable compositions are disclosed in U.S. Pat. Nos. 3,875,088 and 3,993,408, wherein thermoplastic binders are utilized in combination with a cellulosic fibrous filler and a water-soluble metallic soap.

Crystal, U.S. Pat. No. 3,936,519 discloses a technique of extruding a foamed plastic sheath around a graphite-clay lead which has applied thereto a heat-activatable adhesive. In Crystal, the inside diameter of the sheath is fixed by the diameter of the rod-like, solid graphite-clay lead co-extruded therewith.

The pencil sheath compositions and respective methods in all of the above-cited prior art, except those in U.S. Pat. Nos. 3,936,519 and 4,176,978, do not employ blowing or foaming agents. Furthermore, the compositions thereof are designed for, and limited to, use in conventional or crystalline graphite pencils.

U.S. Pat. No. 4,413,921 discloses the use of polyolefins such as polyethylene, polypropylene, and equivalent derivatives thereof to form sharpenable cosmetic pencil barrels.

While some of the thermoplastic-based cosmetic pencil barrels of the prior art have proven to be generally acceptable, the commercial success of others has been somewhat limited, due to inherent drawbacks. Problems such as undesirable breakage, due to brittleness often occur. Another major problem often encountered with some of the pencil barrels of the prior art is that of poor, non-uniform sharpenability. Poor sharpenability can result in the penetration of the cosmetic marking core by small barrel chips or shavings. With respect to the extruded cosmetic pencil barrels, certain problems still persist. Typical of such problems is that of "weld lines", i.e. the undesirable, nonaesthetic striations on the outer wall, caused by use of conventional "spider-type" extrusion pins. Additional problems often encountered in some of the extrusion methods of the prior art are those such as non-uniformity of the outer wall surface of the pencil barrels and the poor printability thereof. Difficulty in maintaining uniform wall thickness within narrow limits is also a frequently incurred problem. The problem of non-uniform barrel wall thickness combined with those of poor internal structural integrity often results in penetration of the solvents from the marking core through the walls of the pencil barrel. The foregoing problems are often directly associated with the particular extrudable composition and the extrusion process selected therefor, especially the die shaping and cooling steps.

The above-mentioned combined factors of composition and extrusion conditions are interdependent. Hence, in order to be useful in the production of cosmetic pencils, the barrels utilized therein must possess the desired characteristic of good compatibility with the cosmetic marking core material, have outstanding sharpenability, printability, good concentricity, uniform wall thickness, good impermeability, and storageability.

SUMMARY OF THE INVENTION

The present invention concerns the preparation of thermoplastic, resin-based, sharpenable pencil barrels which are useful in the production of cosmetic pencils. More precisely, it involves the production of sharpenable pencil barrels by extruding a foamable thermoplastic-based composition, under controlled conditions. The novel combination of the particular extrudable, foamable composition and the extrusion process utilized yields a pencil barrel having the above-mentioned outstanding profile characteristics including linear cellular formulation.

BRIEF DESCRIPTION OF THE DRAWINGS

For a better understanding of the present invention, reference is made to the following detailed description considered in conjunction with the accompanying drawings, in which.

DETAILED DESCRIPTION OF THE INVENTION

While useful in yet further conventional products, the pencil barrels of this invention are specially suitable for the production of certain cosmetic products. Accordingly, the present invention will be described with emphasis on particular sharpenable cosmetic products.

Figure 1:
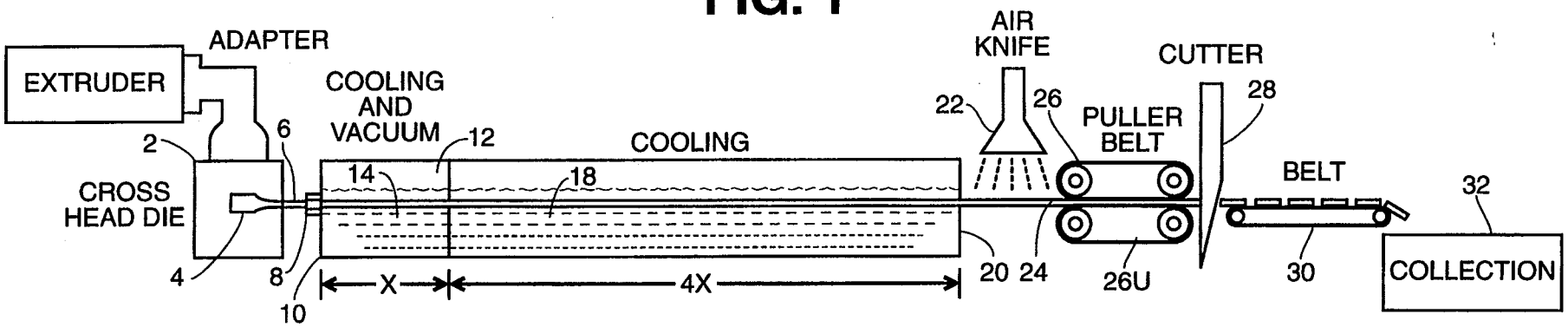
FIG. 1 is a schematic showing the apparatus for implementing the various post-extrusion steps utilized in the practice of this invention.
Figure 3:
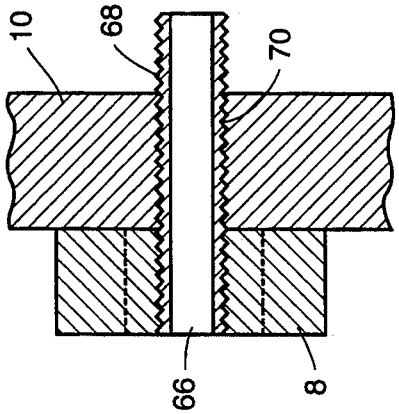
FIG. 3 is a simplified cross-sectional view of the vacuum chamber having the calibrator affixed thereto at the entrance section of the cooling system.
Figure 2:
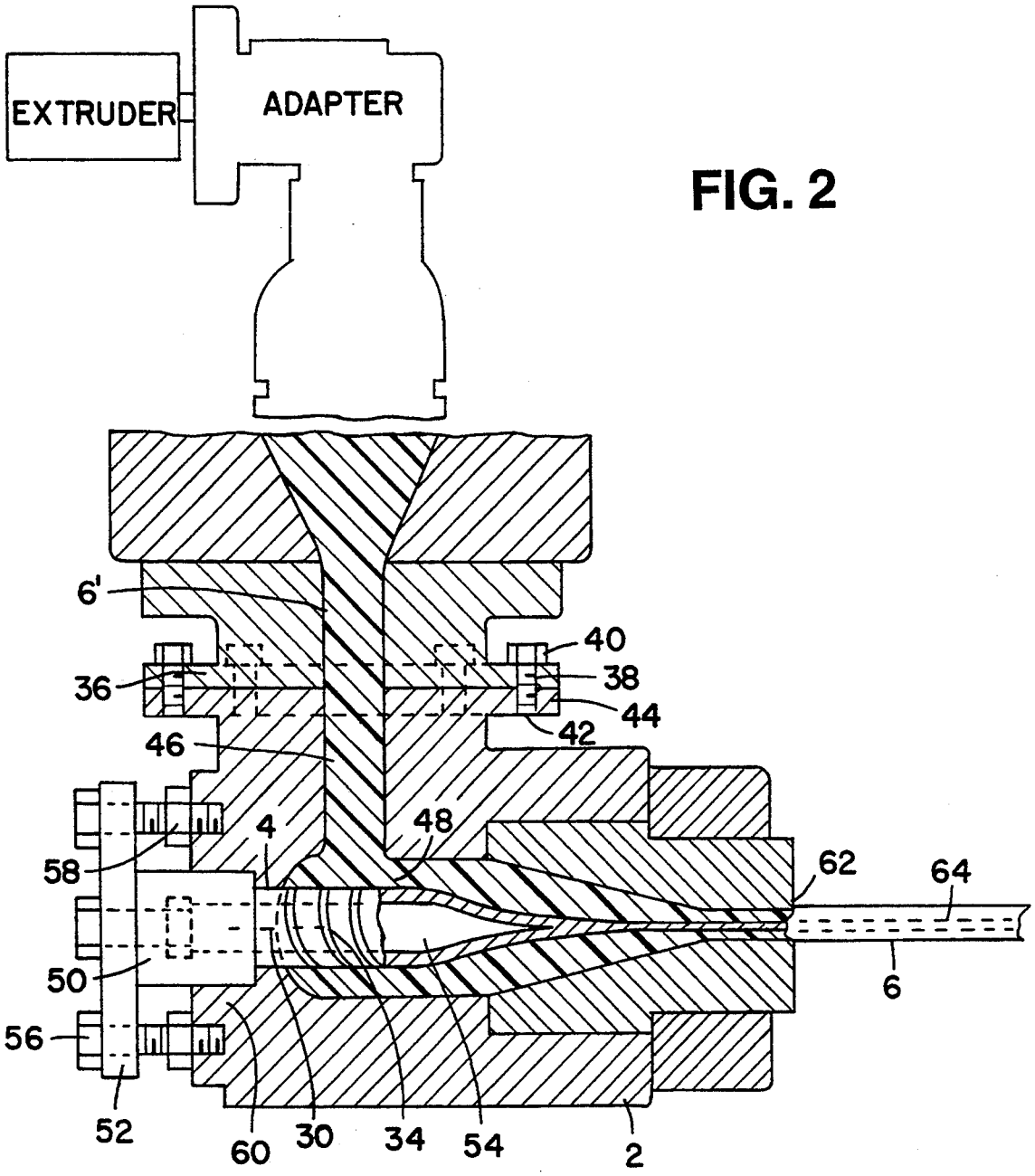
FIG. 2 is an enlarged cross-sectional, top plan view of the crosshead extrusion die having the spirally grooved, shaping pin mounted therewithin.

The present novel pencil barrels are produced by extruding a homogeneous blend of a foamable, thermoplastic, resin-based composition, under controlled extrusion and cooling conditions, employing the apparatus shown in FIGS. 1–3. The foregoing drawings and those in the remaining FIGS. 3–7 will be explained in greater detail hereinbelow. Before discussing the apparatus employed in the method of fabricating the pencil barrels according to this invention, a description of the extrudate is given to adequately describe the foamable composition utilized to make the present novel pencil barrels.

The use and respective proportionalities of a thermally decomposable foaming agent and, at least, one lubricant, in the presence of a thermoplastic polymer material, causes the novel extrudable composition to foam.

In general, the foamable, extrudable composition according to this invention is essentially comprised of a thermoplastic resin, a foaming agent, an impact modifier, and, at least, one lubricant.

Regarding the ratios of the ingredients utilized in the preparation of the extrudates, in accordance with the present invention, a typical formulations would essentially comprise, based on the total weight of the composition, from about 89 to about 102 percent of the thermoplastic resinous material, from about 0.3 to about 1.7 percent of either an inorganic or an organic foaming agent, and from about 1.0 to about 2.0 percent of a lubricating agent.

In addition to being chemically compatible with the various components comprising the foamable extrudable composition, the particular thermoplastic material must also meet certain physical property requirements.

The usefulness of the thermoplastic materials in the practice of this invention can be determined on the basis of various standard test methods. Included among such methods are those designed for determining relative molecular weight based on a softening point and melt index, melt elasticity, and shear response. For example, for linear polymers, all other structural characteristics being equal, the lower the Melt Index, e.g. the higher the molecular weight, the greater the hardness of the particular thermoplastic material. A specific example of such a test is ASTM D1238 which is based on determination of the Melt Flow Rate of resin. The foregoing test method essentially involves placing a prescribed amount of the test resin, i.e. thermoplastic material, into a cylinder which is provided with a plunger and a means of heating the test resin and then measuring the amount of melted test material, in grams, which drops over a ten minute period. The numerical value reflective of the respective melt index is then determined by correlating the equivalent value of the Melt Flow Index. An additional standard test useful in evaluating the thermoplastic materials for use in the present invention is ASTM E28 in which softening point values are obtained in degrees Fahrenheit.

Among the thermoplastic materials which are useful as resinous bases in the present invention, are polyvinyl chloride, cellulose acetate, synthetic elastomers, natural rubber, polyolefins such as polyethylene, polypropylene, and the chlorinated equivalents thereof.

The polyvinyl chloride stabilizers useful in the practice of this invention are the mercaptides such as the dibutyl-tin dilaurate, dibutyl-tin diacetate, dibutyl-tin dicrotonate, dibutyl-tin maleate, and other organo-tin salts of carboxylic acids, mercaptoesters, and tin-organo compounds such as tin mercaptide, dibutyl-tin benzenesulphenamide, the mercaptityl or mercapto derivatives, the lead and cadmiun salts of 1,3,5,7-tetramethyloctyl mercapto acetic acid, and the lead and cadmium salts of dimethyl and diethyl-dithiocarbamates.

The foaming agents useful in the practice of this invention are those substances capable of thermally decomposing to yield a sufficient amount of gas to thereby cause the molten thermoplastic-based material to expand during extrusion. Hence, the suitable foaming agents must have a thermal decomposition temperature within the range in which the extrusion is carried out. Included among those organic compounds useful as foaming agents are 2,2'-azobisisobutyronitrile, azodicarbonamide, 4,4'-oxybis (benzenesulfonyl hydrazide), and dinitrosopentamethylenetetramine.

Among the inorganic substances useful as foaming agents in accordance with this invention are included sodium carbonate and sodium bicarbonate.

The various other functional ingredients in the extrudable compositions according to this invention, like the thermoplastic resinous materials, may vary. For example, the foaming agent and the amount thereof may vary depending on the respective thermoplastic resinous material utilized. For instance, when either polyethylene or polypropylene is utilized as the thermoplastic resinous-base material, a lesser amount of foaming agent is required. Other ingredients such as the filler and the pigment component may also vary.

The thermoplastic resin-based composition according to this invention, can also include a pigment component, an impact modifier, and a filler or a nucleating agent. For example, conventional substances such as mica, silica, titanium dioxide, talc, calcium stearate, and the equivalents thereof may be utilized as the nucleating filler component.

Regarding the suitable pigment components which may be used in the cosmetic pencil barrel formulations according to this invention are included those substances which do not have thermal decomposition temperatures below or otherwise falling within the range of the extrusion temperatures. Naturally, the selection of the pigment component will depend on the color ultimately desired for the cosmetic pencil barrel.

Among the useful pigment components are included carmine, bismuth oxychloride, zinc oxide, ferric oxide, ferrous oxide, kaolin, ultramarine violet-3519, ultramarine blue, chromium oxide, chromium hydroxide, zinc oxide, silica, and manganese violet. Other examples include lakes of organic colorants such as FD & C Red No. 7 calcium lake, (Colour Index [1971] Pigment Red 57) dicalcium salt of 3-sulfo-4 toluylazo-2-hydroxy-3-naphthoic acid; FD & C Yellow No. 5 aluminum lake, Trialuminum salt of 3-carboxy-5-hydroxy-1-p-sulfophenyl-4-p-sulfophenylazopyrazole; D & C Red No. 9 barium lake, and D & C Red No. 30. Those skilled in the art are familiar with the nomenclature and complex structures of the foregoing Food, Drug and Cosmetic (FD&C) and Drug and Cosmetic (D&C) pigments. More detailed definitions of these pigments are set forth in Pigment Handbook, Vol. I (Edit.. by T. C. Patton) pages 500, 509, and 967, respectively. Additional examples include talc, mica, titanium dioxide; and any of the foregoing carried on the surface of talc, mica, or titanium oxide; and titanated mica. The term "pigment" includes mixtures of two or more of the foregoing.

For the purposes of this invention, it is preferred that the thermoplastic material be a polyvinyl composition such as polyvinyl chloride and be present in an amount of about 100 parts, by weight; that the foaming agent be an inorganic salt such as sodium carbonate; present in an amount of from about 0.5 to about 0.9 parts, by weight; that the stabilizer for the polyvinyl chloride be a tin mercaptide and be present in an amount from about 1.3 to about 1.7 parts; that the impact modifier be "Paraloid KM 318F" (an acrylic produced by Rhom & Haas) and be present in an amount of from about 5.0 to about 10.0 parts; that the lubricant be a combination of calcium stearate, paraffin wax, and stearic acid, and be present in an amount of from about 1.0 to about 2.0 parts; that the nucleating filler component be calcium stearate and be present in an amount of from about 4.5 to about 5.5 parts; and that the pigment component be carbon black and be present in an amount from about 0.5 to 10.0 parts.

With reference to FIG. 1, there is shown a simplified schematic of the apparatus utilized in the die casting, cooling, and finishing phases in the preparation of the cosmetic pencil barrels according to this invention. The entire post-extrusion sequence is carried out utilizing the apparatuses depicted in FIG. 1:

The foamable composition previously admixed as described above, is introduced, at ambient temperature, to the hopper (not shown) of a typical, conventional extruder. At the discharge end thereof, the extruder is equipped with a crosshead die 2 having a spirally grooved shaping pin 4 concentrically mounted therein at the base of said crosshead die 2. Said shaping pin 4 is provided with a hollow center 54 to facilitate more uniform heat distribution throughout the molten extrudate. Those skilled in the art of extruding thermoplastics will appreciate the fact that in a typical extrusion process there are several sequential heating zones through which a rotating extruder screw (not shown) continuously agitates and forces the molten extrusion composition 6, onto the shaping die 2. Upon entry into the crosshead shaping die 2, as illustrated in FIG. 2, the molten extrudate 6 is usually forced through a breaker plate and an adapter assembly (not shown) at the exit end of the extruder and, into the crosshead die 2. As will be discussed below, the shaping pin 4 which is mounted within the crosshead die 2 allows for the formation of a continuous foaming tubular extrudate 6.

Upon exiting the crosshead die 2, the thusly formed tubular extrudate 6 is drawn through a calibrator 8 affixed to and extending through the front 10 wall on the entrance side of a vacuum chamber 12 situated at the initial stage of the cooling system. The hot tubular extrudate 6 is then drawn into and through an initial water bath 14 contained within said vacuum chamber 12 and through an outlet (not shown) within the rear wall 16 of said vacuum chamber 12 prior to entering a second water bath 18. As a result of actually being drawn through the calibrator 8 and into the initial water bath 14 within the vacuum chamber 12, the tubular extrudate 6 is continuously being shaped into the final configuration which exhibits all of the desired profile characteristics consistent with this invention.

Upon exiting the second water bath 18 through the rear wall 20 thereof, the thusly cooled, continuous, tubular extrudate 6 is shortly thereafter passed through an air knife 22 and then pulled through the pinch-point formed by a pair of horizontally mounted, over and under endless conveyor belts, 26 and 26U, to a cutting station 28, whereupon, the cooled extrudate 6 is cut into the desired pencil lengths. Subsequent to being cut the thusly obtained cosmetic pencil barrels are further transported by means of a conventional conveyor belt 30 to the collection stage 32, i.e. packaging phase, for subsequent use in the manufacturing of cosmetic pencils.

Referring to FIG. 2 there is shown an enlarged cross-sectional, top plan view of the crosshead die 2 (detached at the lower end from the adapter by which said crosshead die is connected to the extruder system) having a shaping pin 4 therein provided with a spiral-like groove 34. The crosshead die 2 is mounted onto the outlet, i.e. discharge end, of the adapter assembly, (not shown) which is affixed to the outlet end of the extruder (not shown). The crosshead die 2 is affixed to said adapter assembly (not shown) by means of an annular connecting flange 36 extending outwardly from the outlet end of said adapter assembly and which is provided with a series of threaded female openings 38 through each of which a threaded bolt 40 is tightly screw-fitted. Said bolt 40 extends through a respective female threaded opening 38 within a series of such openings in a corresponding flange 44 at the inlet end of said crosshead die 2 contiguously aligned with said connecting flange 36 of said adapter assembly (not shown). The crosshead die 2 is secured to said adapter assembly by means of a series of bolts 40 each of which respectively corresponds to one of said threaded female openings 38.

The crosshead die 2 is provided with an inlet channel 46 through which the molten extrusion compositions 61 flows, inwardly, from the extruder to the annular reservoir area 48 of said crosshead die 2 in a direction transaxial to that of said crosshead die 2, wherein the spiral-like groove 34 shaping pin 30 is concentrically mounted, to the base 50 of said crosshead die 2. Said shaping pin 30 is tapered, towards the end opposite that at which it is affixed to the base 50 of said crosshead die 2 by means of a annular mounting plate 52. The tapered end of the shaping pin or "land" as it is known throughout the industry is tapered in a direction coaxial to that of the outward flow of the molten extrusion composition 6 within said annular reservoir area 48 of said crosshead die 2. The length of the land can be varied to further alter the structure of the tubular extrudate 6. The annular mounting plate 52 is provided with a series of threaded female openings 54 through each of which a threaded bolt 56 is tightly screw-fitted so as to extend through a receiving nut 58 affixed to the outer wall 60 of said crosshead die 2.

Upon being forced from the outlet, i.e. discharge end, 62 of said crosshead die 2, the still somewhat hot tubular extrudate 6' having a hollow center therewithin continues to expand, slightly, up to entry into the cooling vacuum chamber 12 through the calibrator 8. The final shaping of the tubular extrudate 6 occurs within the calibrator 8, wherein the desired profile characteristics are achieved and permanently set, as foaming within the tubular extrudate 6 is terminated by the combined restraint of the calibrator 8 and the rapid, initial cooling effect of the water bath 14 within the vacuum chamber 12. Final cooling of the tubular extrudate 6' occurs in the extended vacuum-free water bath 18 and by means of the air knife 22 immediately thereafter.

Referring to FIG. 3, a near-full scale cross-sectional view of the calibrator 8 is shown having therewithin a flow channel 66 through which the thusly formed tubular extrudate 6 is drawn through the inlet wall 10 into the vacuum chamber 12. The flow channel 66 of said calibrator 8 is provided with male threads 68 which correspond to female threads 70 within the inlet wall 10 of said vacuum chamber 12 whereby said calibrator is tightly screw-fitted to said inlet wall 10 of said vacuum chamber 12.

Figure 5:
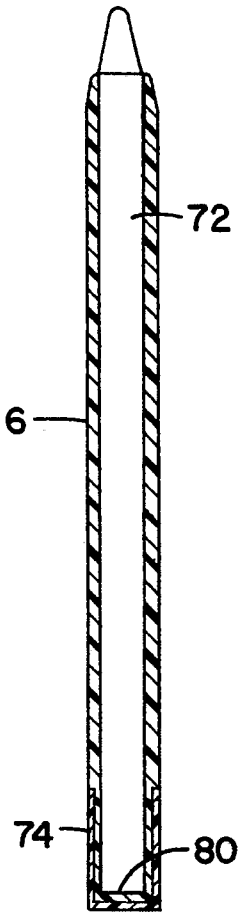
FIG. 5 is a cross-sectional view of the pencil barrel of FIG. 4 along line 5—5.
Figure 4:
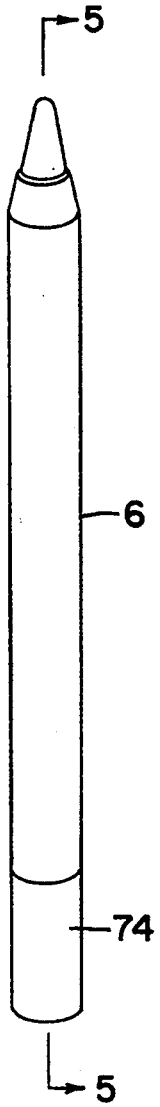
FIG. 4 is an elevational view of the trimmed pencil barrel having the cosmetic core marking material contained therewithin.

FIG. 4 illustrates a perspective view of FIG. 5 of the sharpenable cosmetic pencil according to this invention, comprising the cut pencil-length barrel extrudate 6' having encased therein a cosmetic marking core. The pencil-length barrel tubular extrudate 6 has been sharpened at the point end, and is provided with an end cap 74 which is fitted thereunto at the end opposite that which has been sharpened.

FIG. 5 shows a longitudinal, cross sectional view of the cosmetic pencil illustrated in FIG. 4 wherein the cosmetic marking core contained therein has been sealed with a conventional wax such as paraffin and a hot-melt material such as an ethylene-vinyl acetate copolymer, and the end cap 74 is affixed thereon.

Figure 5A:
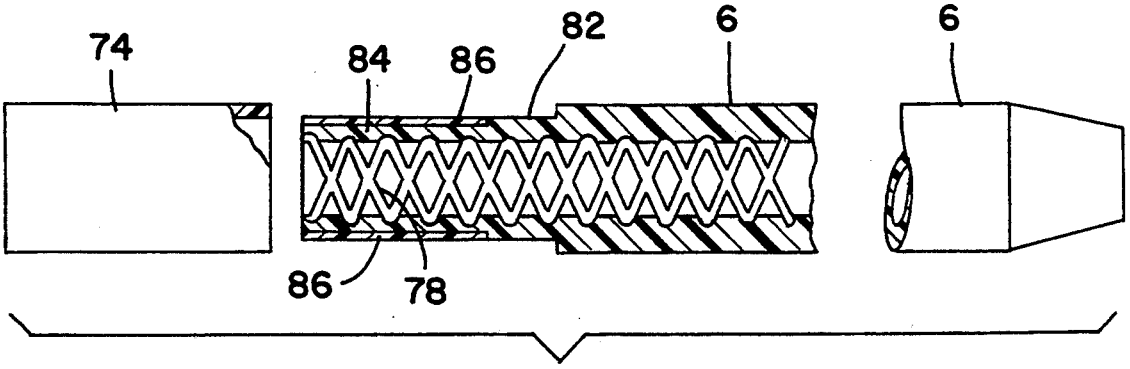
FIG. 5A is a partial cross-sectional view of the pencil barrel shown in FIG. 4, illustrating the machined barrel having the end cap detached therefrom, prior to the introduction of the cosmetic marking core material.

FIG. 5A illustrates a longitudinal cross-sectional view of the machined pencil-length barrel tubular extrudate 6, with the end cap 74 detached therefrom prior to introduction of the cosmetic core material (not shown). As a result of machining, the pencil barrel is provided with a slightly sharpened top end having an annular shoulder 86 thereon and, at the bottom end opposite said sharpened end, a portion thereof of which wall thickness of the barrel base has been reduced to a first ledge 82 and, then to a second ledge 84, in order to receive said end cap 74. A conventional adhesive layer 82 such as an epoxy or any suitable thermally curable composition is applied onto said second ledge 84 to secure the end cap 74 which is affixed thereon subsequent to the introduction of the wax sealant 80 as shown in FIG. 5. A portion of the inner wall of the hollow within said pencil barrel has been scored with a ball-pin in a manner similar to a crisscrossing, double helix 78 to increase the adherence thereto of the cosmetic marking core material subsequently introduced therein.

Figure 6:
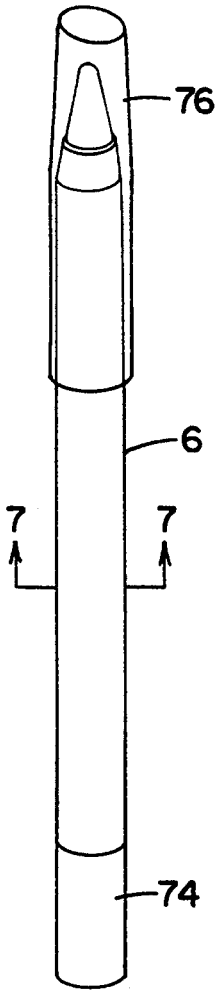
FIG. 6 is an elevational view of the completely finished cosmetic pencil prepared, in accordance with this invention.

FIG. 6 illustrates an external, lateral view of the completely assembled sharpenable cosmetic pencil of this invention, wherein the pencil barrel 6 has the cosmetic marking core material encased therein as shown in FIG. 5 and is fitted with a removable transparent cap 76.

Figure 7:
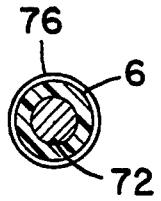
FIG. 7 is a cross sectional diagram of the finished cosmetic pencil shown in FIG. 6 through line 7—7.

Referring to FIG. 7 there is shown a top plan cross-sectional view of the sharpenable cosmetic pencil of this invention as illustrated in FIG. 6 and viewed directly downward through the transparent cap 76 from the sharpened end of the cosmetic marking core encased within the pencil barrel 6.

The following Examples further illustrate certain aspects of the present invention and are not intended to limit the scope thereof to such.

EXAMPLE I

A quantity of a foamable, extrudable composition was prepared for the manufacture of a commensurate number of cosmetic pencil barrels in accordance with this invention. The aforesaid extrudable composition was prepared by blending a homogeneous mixture of the ingredients required therefor in a Henshel Mixer, while gradually adjusting the temperature therein as follows:

The temperature within a Henshel Mixer of adequate size was adjusted to and maintained within a range of from about 125° Fahrenheit to about 200° Fahrenheit as the ingredients were sequentially added. Initially, 100 parts of a polyvinyl chloride resin and 1.5 parts of TM-181 (a tin mercaptide stabilizer supplied by Ventron) were separately admixed therewith, at five minute intervals, as the temperature was increased to and maintained at 125° Fahrenheit for about 10 minutes; thereafter the temperature was gradually increased to and maintained at 150° Fahrenheit for a period of approximately 20 minutes as 0.5 parts of a calcium stearate processing aid, 1.0 parts of a paraffin wax lubricant, 0.5 parts of a stearic acid lubricant, 0.7 parts of Cellogen AZRV (an azodicarbonamide foaming agent supplied by Uniroyal), and 9.0 parts of Paraloid KM 318F (an impact modifier supplied by Rohm & Haas) were each respectively added thereto at five minute intervals; thereafter 5.0 parts of a calcium carbonate nucleating agent were added as the temperature was adjusted to and maintained at 190° Fahrenheit for about 5 minutes; and, lastly, 1.5 parts of a carbon black pigment component were added to the mixture as the temperature thereof was adjusted to and maintained at about 200° Fahrenheit for a period of 5 minutes.

The foamable, extrudable composition prepared in the above-described manner was thereafter utilized for the preparation of a quantity of cosmetic pencil barrels consistent with the present invention. The extrusion process was carried out by the use of a conventional screw-type extruder having a crosshead die connected thereto by means of an adapter assembly as shown in FIG. 2 in accordance with this invention. Said crosshead die was provided with a specially designed shaping pin, in accordance with this invention, as also shown in FIG. 2. The extrusion process was carried out by introducing a quantity of the foamable, extrudable composition into a vibrating hopper of the extruder at a temperature of about 300° Fahrenheit. As previously mentioned, the conventional screw-type extruder such as that utilized herein, has three heating zones. Zone 1 which is located in the feed section of the extruder is maintained at a temperature of about 300° Fahrenheit. Zone 2 which is usually the most extensive segment of the entire extrusion process is the interim phase which occurs in the compression section of the extruder and is maintained at a temperature of about 350° Fahrenheit. Lastly, Zone 3 is the metering section or the final phase of the extruder process wherein the temperature is also maintained at about 350° Fahrenheit. The speed of the extruder screw was maintained at about 30 rotations per minute, and the pressure, between 2000 and about 2200 psi. The exit temperature of the melt, i.e. extrudate, was about 385° Fahrenheit as it passed through the adapter assembly and into the crosshead die, whereupon the tubular extrudate was formed.

Shortly after being discharged from the crosshead die as a result of the back pressure caused by the rapidly accumulating extrudate within the annular chamber surrounding the shaping pin within said crosshead die, the extrudate is actually sucked through the calibrator and into the vacuum chamber within the initial phase of the cooling system as shown in FIG. 1.

Upon passing through the remaining stage of the cooling system as shown in FIG. 1, the thus far cooled extrudate is passed by an air knife prior to being pulled through the pinch point of a pair of over and under conveyor belts to a cutting station as shown in FIG. 1. The rate of speed at which said conveyor belts pulled the extrudate was set at about 9.0 feet per minute. Subsequent to being cut into the desired pencil barrel lengths, The thusly obtained cosmetic pencil barrels were tested for shore hardness by means of a Durometer. The Durometer is an instrument designed and produced by the Shore Company, Jamaica, N.Y. to measure the structural hardness of a substance such as a polymer. In essence, the Durometer is a manually operated, gauged instrument provided with a spring loaded plunger and penetration pin. The tests results are measured in terms of durometer units as read from a graduated scale.

Based on a D scale from 0 to 100 durometer units, the cosmetic pencil barrels prepared herein registered an average hardness of between 50 and 60 units. The thusly obtained cosmetic pencil barrels were machined in a manner similar to that illustrated in FIG. 5A, in preparation for the manufacturing of eyeliner pencils.

Prior to the introduction of the cosmetic marking core material, the pencil barrels were machined, i.e. by cutting at each end thereof and a portion of the wall of the hollow is helically scored, in the manners respectively shown in FIGS. 5 and 5A. Each of the machined pencil barrels was vertically placed, with the bottom end up, into a semi-automatic, rotating casting apparatus provided with a series of equal-spaced barrel holders. Each of said barrel holders was provided, at the bases thereof, with a mold configuration by which the initial points of the cosmetic core material as shown in FIGS. 4–6 is formed. Thereafter a conventional, cosmetic marking core composition was thermally casted into each of the machined pencil barrels, and a conventional wax sealant was introduced at the bottom end, i.e. opposite the pointed end, as shown in FIG. 5. A conventional thermoplastic adhesive was then applied to the outer surfaces of each second ledge as shown in FIG. 5A to secure the bottom end cap which was subsequently affixed thereon as illustrated in FIGS. 4 and 6. Upon removal from the casting apparatus, test samples of the resultant eyeliner pencils exhibited the desired characteristics of excellent sharpenability, combined rigidity and flexibility, uniformity, and outstanding payoff.

EXAMPLE II

An additional quantity of foamable, extrudable composition was prepared for the manufacture of a number of cosmetic pencil barrels, according to this invention, which were considerably more rigid than those obtained in Example I, hereinabove. The respective procedural blending and extruding steps were similar to those set forth in Example I, however, the formulation of the extrudable composition was modified as follows:

All of the ingredients utilized were essentially the same as those in the foregoing Example, except the amount of KM 318 impact modifier was decreased from 9.0 to 4.0 parts, by weight, and that of the paraffin wax lubricant from 1.0 to 0.6 parts, and the 0.5 parts, by weight, of a stearate acid processing aid was replaced with 0.6 parts of Loxiol G-30 (a commercially available lubricant supplied by Henkel).

The extrusion process utilized herein was the same as that described in Example I, hereinabove.

The resultant cosmetic pencil barrels obtained herein displayed the desired physical and aesthetic characteristics comparable to those of the pencil barrels prepared in Example I, supra. In particular, the Shore Hardness tests yielded an average measurement of about 68.5 units which reflected a considerably harder barrel than those obtained prior hereto in Example I. Furthermore, eyeliner pencils prepared using the thusly obtained pencil barrels exhibited sharpenability characteristics comparable to the cosmetic products produced in the foregoing Example.

EXAMPLE III

The respective procedural blending and extrusion steps in Example I were again repeated to prepare an additional quantity of cosmetic pencil barrels. However, the formulation of the extrudable, foamable thermoplastic composition was modified by the addition of 1.0 part, by weight of K175 (a commercially available impact modifier produced Rhom & Haas) to facilitate the extrusion process.

The resultant cosmetic pencil barrels thusly obtained were comparable, in every aspect, to those respectively prepared in Examples I and II hereinabove.

EXAMPLE IV

The procedural steps set forth in Example I hereinabove were repeated to prepare an additional number of sharpenable cosmetic barrels, in accordance with this invention, using polystyrene, in place of polyvinyl chloride, as the thermoplastic material.

Two separate quantities of the thusly prepared cosmetic pencil barrels were tested for their structural integrity and subsequently utilized in the manufacturing of eyeliner pencils, in one case, and in creme eyemarker pens, in the other. The respective formulations of the marking cores of the eyeliner pencils and that of the creme eyemarker essentially comprised similar hydrocarbonous-based compositions with varied pigment components. The test results of the sharpenable pencil barrels produced herein and the corresponding cosmetic products prepared therewith were comparable to those obtained in Example I, above. Furthermore, the cosmetic products prepared using the present novel sharpenable pencil barrels were superior to conventional eyeliner pencils and creme eyemarker pens.

EXAMPLE V

The procedural steps outlined in Example I hereinabove were repeated to prepare a further number of sharpenable cosmetic pencils, according to this invention, except polypropylene was substituted for the polyvinylchloride as the thermoplastic material.

Upon being tested for structural properties and subsequently utilized in the manufacturing of eyeliner pencils and creme eyemarkers as described hereinabove, the cosmetic pencil barrels obtained herein were comparable, in all aspects, to those in the preceding examples.

Summarizing, it is thus seen that this invention provides an alternate, novel method for the preparation of pencil barrels which are readily useful in the manufacturing of, in particular, cosmetic products. The pencil barrels, according to this invention, can be prepared by extruding a foamable, thermoplastic resin-based composition to thereby form a tubular extrudate, and cooling the thusly obtained tubular extrudate, under controlled conditions, and cutting said tubular extrudate into the desired pencil lengths. While readily useful in a broad range of commercial applications, the pencil barrels obtained in accordance with this invention are particularly useful in a variety of cosmetic products such as eyeliner pens and eyeshadow pencils.

As a result of the novel combination of the foamable composition and the extrusion process utilized, the cosmetic pencil barrels disclosed herein possess all of the desired physical and chemically inert characteristics. For example, the present novel pencil barrels display outstanding sharpenability, rigidity, prolonged storageability, i.e. resistance to atmospheric conditions, and uniform concentricity.

The rigid, impermeable pencil barrels prepared, in accordance with this invention, are also readily useful in the manufacturing of conventional pencils, pens, and other related writing or marking devices. Such devices include those non-sharpenable products in which an ink-dispensing cartridge is encased within the barrel. In those instances, the barrel would normally be provided with an appropriate point at one end and a cap or closure fixture at the opposite end. Furthermore, the uniformly smooth surfaces of the pencil barrels are more printable than those of the prior art. Subsequent to machining, i.e. finishing the respective ends of the cosmetic pencil barrels into desired configurations, a conventional marking core material may then be introduced by casting or any other suitable means to obtain superior cosmetic products such as eyeliner pencils, eyeshadow pencils, creme eyemarker pens, and lip shaper pencils.

It will be understood that the embodiments described herein are merely exemplary and that a person skilled in the art may make many variations and modifications without departing from the spirit and scope of this invention, as defined by the following claims.

What is claimed is:

1. A cosmetic pencil barrel composition consisting essentially of a thermoplastic material selected from the group consisting of polyvinyl chloride (PVC) in combination with a PVC stabilizer, poly(N-vinylpyrrolidone), cellulose acetate, urethane polymers, synthetic elastomers, natural rubber, polyethylene, polypropylene, polystyrene, and mixtures thereof, a foaming agent, a lubricant, a pigment, a nucleating filling component, and an acrylic impact modifier; wherein the barrel composition exhibits linear cellular formation and the inner surface of the barrel is scored to increase adherence of the cosmetic marking material which is made by a method comprising the steps of:

(a) mixing a molten thermoplastic composition comprising a foamable thermoplastic material selected from the group consisting of polyvinyl chloride (PVC) in combination with a PVC stabilizer, poly(N-vinylpyrrolidone), cellulose acetate, urethane polymers, synthetic elastomers, natural rubber, polyethylene, polypropylene, polystyrene, and mixtures thereof; a foaming agent, a lubricant, a nucleating filler component, and an acrylic impact modifier, (b) extruding the mixture of step (a) through a crosshead die to form a continuous tubular extrudate, (c) introducing the tubular extrudate into a cooled water bath within a vacuum chamber through a calibrator designed to control foaming of the tubular extrudate, (d) cutting the cooled tubular extrudate into the desired pencil length.

2. The method of claim 1 wherein after step (c) the tubular extrudate is discharged from the vacuum chamber and introduced into a second water bath prior to cutting the cooled tubular extrudate into the desired pencil lengths.

3. The method of claim 2 wherein the foaming agent is sodium bicarbonate, 2,2'-azobisisobutyronitrile, azodicarbonamide, 4,4'-oxybis(benzenesulfonyl hydrazide), and dinitrosopentamethylenetetramine.

4. The method of claim 3 wherein the lubricant is calcium stearate, stearic acid, stearyl alcohol, and mixtures thereof.

5. The method of claim 4 wherein the foaming thermoplastic composition comprises 89–102 parts of the foamable thermoplastic material, 0.3 to 1.7 parts of the foaming agent, 1.0–2.0 parts of the lubricant, 1.0 to 10.0 parts of the nucleating filling component, and 8.0 to 10.0 of the acrylic impact modifier.

* * * * *